United States Patent [19]

Halm

[11] 4,262,074

[45] Apr. 14, 1981

[54] PHOTOGRAPHIC COPY METHOD AND MATERIALS

[75] Inventor: James M. Halm, Lombard, Ill.

[73] Assignee: A. B. Dick Company, Niles, Ill.

[21] Appl. No.: 95,653

[22] Filed: Nov. 19, 1979

[51] Int. Cl.[3] ..... G03C 1/52

[52] U.S. Cl. ..... 430/19; 430/281; 430/283; 430/292; 430/338; 430/332; 430/337; 430/541; 430/334

[58] Field of Search ..... 430/332, 338, 340, 19, 430/283, 281, 337, 338, 541, 435, 292, 334, 70

[56] References Cited

U.S. PATENT DOCUMENTS

| | | | |
|---|---|---|---|
| 3,501,308 | 3/1970 | Adelman | 430/340 |
| 3,600,169 | 8/1971 | Lawton | 430/70 |
| 3,936,307 | 2/1976 | Asakawa et al. | 430/334 |
| 4,036,648 | 7/1977 | Engler et al. | 430/344 |

FOREIGN PATENT DOCUMENTS

| | | | |
|---|---|---|---|
| 1382748 | 2/1975 | United Kingdom | 361/433 |

*Primary Examiner*—Won H. Louie, Jr.
*Attorney, Agent, or Firm*—McDougall, Hersh & Scott

[57] ABSTRACT

An imaged development process and materials wherein use is made of a photographic medium sensitive to ultraviolet radiations and formulated of an alkyl cellulose derivative and 7,7,8,8-tetracyanoquinodimethane.

31 Claims, No Drawings

PHOTOGRAPHIC COPY METHOD AND MATERIALS

This invention relates to a photocopy process and to a material for use in the practice of same.

It is an object of this invention to provide a new and improved photocopy process in the form of a process for producing copy and it is a related object to provide new and improved components for use in the practice of same in which use is made of low cost and readily available materials; in which the image produced is stable over an extended period of time; in which the color intensity of the image can be varied with the intensity of the image increased as desired for various purposes; in which the image can be caused to vanish after visual development, for security reasons or otherwise; and in which the image can be fixed for permanent retention of the developed image.

These and other objects and advantages of this invention will hereinafter appear and for purposes of illustration, but not of limitation, the invention will hereinafter be described with reference to the following examples.

Briefly described, the invention is based upon the production of suitable charge transfer complexes between a natural or modified natural polymer electron donor and an electron acceptor compound provided in a coating on a suitable carrier, whereby the color change is caused to take place in response to exposure to ultraviolet light to provide a differentiation in colors between the exposed and non-exposed areas. The invention will hereinafter be described by way of the following examples in which 7,7,8,8-tetracyanoquinodimethane represents the acceptor compound and a cellulose derivative such as hydroxyethyl cellulose, hydroxypropyl cellulose and ethyl cellulose represent the natural or modified natural polymer.

EXAMPLE 1

600 ml of 50% by weight of ethyl alcohol in water.
30 grams hydroxyethyl cellulose.
42 ml tetrahydrofurane saturated with 7,7,8,8-tetracyanoquinodimethane (TCNQ) (8 grams/liter).

TCNQ saturated tetrahydrofuran solution was added to the homogeneous hydroxyethyl cellulose solution and the resulting solution was agitated as by means of a stirrer or roller mill, for two days. During this period of time, the color of the solution changed progressively from light yellow-green to dark green.

The coating composition was applied to a base sheet of low absorption paper, such as Allied basestock X904 of Allied Paper Company or plastic film, such as Mylar with a #40 wire wound rod and the coated substrate was air dried. The dried sheet developed a light yellow-green background color. The sheet was imaged by exposure through a negative mask to blacklight of about 350 nm via a Gelman-Camag Model 51402 assembly having an 8 watt blacklight bulb spaced about 5 inches from the surface of the coated sheet. A green color developed in the exposed imaged areas in contrast to the light yellow-green color in the non-imaged areas. At least 30,000 $\mu J/cm^2$ was required to develop the visible contrasting image.

When the imaged coating was stroked lightly with a wet cotton pad, the intensity of the imaged areas was greatly increased. The irradiated imaged areas changed color to a dark blue-green while the non-imaged background areas were little affected by the wetting with water. The high image contrast faded after most of the moisture evaporated. This process can be repeated several times indicating that the cycling could be repeated indefinitely until after the ambient light begins to affect the coating after a number of hours.

A latent image was formed on the coating by exposure to radiations of 2,000–4,000 $\mu J/cm^2$ of approximately 350 nm black-light. The latent image was subsequently developed into a visible image by wetting the coating as by rubbing with a moistened cotton pad. Upon drying, the image again became latent. The latent image became visible again upon wetting and it can be fixed by treatment with a mild reducing agent.

The initial dry process image is stable when kept in a dark environment. Wet processing is required to fix the coating against deterioration by visible light.

A contrasting image was also obtained by irradiation of the coating for 8 minutes under the Gelman apparatus at about 350 nm. This imaged coating was cycled three times with a wet cotton pad, as previously described, and then cycled twice with a 4% by weight solution of potassium iodide in water. The image retained a blue color while the background became yellow-orange. The imaged coating, when exposed to normal light from overhead daylight fluorescent lamps, remained as a contrasting blue image or a yellow-orange background for more than 43 days. In contrast, when exposed to ambient conditions of sunlight, the non-fixed image vanishes within 1 to 2 days. The image can be fixed to resist such deterioration by treatment with a mild reducing agent such as a water solution of hydroquinone or potassium iodide.

EXAMPLE 2

The composition of example 1 was applied with a #40-60 wire wound rod to coat a 5 mil Mylar substrate and then dried. After 10 minutes of irradiation, as in example 1, a visible image was developed that was less dense than on the paper base stock. The developed image was kept for 6 months in the dark without fading of the light green imaged portion.

A similarly imaged coating on Mylar was wet with water whereby the irradiated imaged areas increased greatly in contrast. A multicellular crack pattern developed which tended to disguise the image information by light transmission but against a white background, the information was clearly visible. The crack pattern was characterized by strong adhesion. It enabled viewing the image by reflection instead of by light transmission. The described coating was stored for two months, without deterioration of the crack pattern. The wet image on Mylar was bright blue compared to an almost colorless backbround.

The formulation of example 1 was modified as follows: To 5 ml of the TCNQ solution of example 1, 5 ml of a 5% solution of a high molecular weight polyvinyl in water (Elvanol 72-60G) was added. An additional 2 ml of tetrahydrofurane saturated with TCNQ was added to the polyvinyl alcohol-cellulose solution. The above composition was applied to Mylar film and dried under a hood at elevated temperature, 150° C. When dry, the coating was imaged through a mask, at 350 nm, for 15 minutes with the Gelman apparatus. The polyvinyl alcohol attenuated the crack pattern into smaller more pleasant cellular units. The image, hardly visible when dry, became vividly visible when wet with water. The imaged coating was enhanced and the image was fixed with a cotton pad wet with a 4% by weight solution of potassium iodide.

In another experiment, the potassium iodide was incorporated directly into the coating formulation as a 4% by weight solution in the ratio of 1 part by weight solution to 5 parts by weight of the composition of example 1 and the dried coating was imaged as described above. The almost invisible image was enhanced and fixed by moistening with a cotton pad wet with water. The 2 fixed blue images on an almost colorless background remained stable for over 30 days.

EXAMPLE 3

The formulation of example 1 was modified by using ethyl acetate as the TCNQ solvent (1.6 grams/liter) instead of tetrahydrofurane. The homogeneous solution changed color from light green-yellow to dark-green in about 2 hours. After 1 hour of stirring, a coating was made from this formulation as in example 1. The dried coating was imaged for 10 minutes by exposure to black-light as in example 1 and the image was intensified with a water cycle as previously described. The image area was intensified to a blue-green. The coating was then wet with 4% potassium iodide solution for 3 cycles. The coating remained fixed, for 20 days with some slight image fading. The background was light-yellow compared to a fixed darker yellow-orange when tetrahydrofurane was used.

EXAMPLE 4

Tetrahexylammonium bromide was added to the formulation in example 1 in the amount of 0.1 gram/15 ml of formulation. Coatings made from this formulation were imaged for 10 minutes under the Gelman apparatus. After about 4 hours, the irradiated imaged areas had begun to turn orange from their original green color. After a day, the orange imaged areas had turned white and the background had turned orange. This white imaged area on a colored background corresponds to a photographic negative. If continued exposure to overhead lighting was continued, the background turned white and all contrast was lost. This loss of contrast occurred during 10–24 hours of ambient light exposure. The negative could be preserved by protecting it from additional light exposure.

The same effect was obtained by using the formulation of example 1 and then swabbing the imaged coating with a solution of ½% tetrahexylammonium bromide via a cotton pad wet with the solution. This process changed the image area almost immediately to a green-orange color and finally to the negative colors described above.

EXAMPLE 5

Coatings were made from the formulation in example 1 modified by the elimination of the cellulose derivative. Attempts to image these coatings from 5 to 15 minutes were not successful.

Coatings of tetrahydrofurane saturated with TCNQ and $C_2H_2OH$ saturated with TCNQ likewise did not image when irradiated under the Gelman apparatus at 350 nm. This experiment verifies the fact that the cellulose derivative is a necessary component in the formulation. The cellulose compound without TCNQ did not produce an image.

EXAMPLE 6

15 ml of formulation 1 was mixed with 1 ml of 2-methoxyethylacrylate. This homogeneous solution was coated onto paper (Allied X904) with a #40 wire wound rod and imaged through a negative mask at 350 nm. After imaging, a cotton pad was used to rub off most of the coating. A hard and thin film of the coating was retained in the paper. The image was retained with only little fading under ambient lighting conditions for 1 week even though this abrasion removed completely all of the image from a coating not containing the acrylate. The retention of an image suggests that the TCNQ system had polymerized the monomer.

EXAMPLE 7

When 1 ml of a saturated dimethylolurea-water solution was added to the formulation in example 1, and the resulting coating was imaged under 350 nm through a negative mask, the whole imaged coating took on a harder and more rugged surface as compared to the imaged coating formed without the urea compound. Wetting with 1% oxalic acid turned the image to a dark brown background and the image slowly faded and vanished over a 3 week period. The formation of a hard coating indicated that polymerization had taken place.

EXAMPLE 8

The formulation of example 1 was coated on a paper substrate as in example 6 (X904) and this coating was protected with a black vinyl covering on both sides of the substrate. After 34 days, the vinyl protective coating was removed and the photosensitive coating was imaged for 10 minutes at 350 nm under the Gelman apparatus. A green image on a buff yellow background resulted. Swatching the coating with a water moistened cotton pad produced a dark-green coloration in the irradiated imaged areas. Under this mode of storage, the shelf life is at least 34 days.

EXAMPLE 9

A 0.05 gram portion of sodium fluorescein was added to 15 ml of the solution of example 1. The green fluorescent solution was stirred until homogeneous and then coatings formed thereof, as in example 1, were imaged through a negative mask with 350 nm radiation. The developed image was greenish-brown on a yellow background. A 1% oxalic acid solution was swatched onto the imaged surface with a cotton pad. The imaged coatings, one with the oxalic acid treatment and another without the oxalic acid threatment were kept under ambient lighting. The image without the oxalic acid treatment faded after about 30 hours while the one treated with oxalic acid vanished only after 7 days.

EXAMPLE 10

A methanol-water-hydroxyethyl cellulose solution was made by dissolving 15 grams of hydroxyethyl cellulose (Natrosol 250L) in 300 ml of 50%/50%=methanol/water. 10 ml of tetrahydrofurane saturated with TCNQ was added to the solution and the formulation was roller-milled for 20 hours. After this time, the somewhat blue-green solution was coated onto paper substrate to give a bluish-white surface. The coating was imaged at 350 nm through a negative mask for 10 minutes under the Gelman apparatus. A green image was obtained on a near white background. When wet with a moistened cotton pad, the green imaged areas of the coating became a vivid blue and were thus greatly intensified by comparison with the non-wet coating. This color persisted for a longer time (~4 minutes) than that from an imaged coating wet with ethanol-water (~1 to 2 minutes). The image vanished under ambient lighting conditions after about 24 hours.

Modifying the formulation by including 0.1 g of tetrahexylammonium bromide to 15 ml of the formulation above produced images which subsequently faded more quickly than the background and thus produced a negative. The state of this negative could be preserved by discontinued exposure to ambient lighting, as by placing the coated substrate in a light tight box.

If the formulation in this example is kept for an extra day before coatings are made, then the blue component is more apparent and coatings made therefrom image green on a blue background.

EXAMPLE 11

Formulations of hydroxypropyl cellulose were prepared by procedures analogous to example 10. A formulation was made by dissolving 25 grams of hydroxypropyl cellulose (Klucel) in 50%/50%=ethanol/water. 1 to 10% to TCNQ saturated tetrahydrofurane was added to the formulations and the solutions were roller-milled for (20–24) hours. Coatings made from these formulations with #40, #60, and #70 wire wound rods were imaged through a negative mask for 10 minutes under the Gelman apparatus. Each coating gave a green image on a light (yellow to green) background. The intensities of images of the hydroxypropyl cellulose coatings were less than those of the hydroxyethyl cellulose coatings. As was observed for hydroxyethyl cellulose coatings, the hydroxypropyl cellulose coatings gave more intense images with increases in coating weights.

When stored in the dark, the coatings of green images produced images of an orange color. The associated backgrounds changed to a light blue color. Inter changing methanol with ethanol in the formulation did not influence the color of the image initially or when the coatings were stored as described. Passing the imaged coatings through heated rollers, from 100° F. to 250° F., increased the rate at which the image changed from green to orange. This color-change intensified the imaged area with respect to the background.

The hydroxypropyl cellulose coatings could be fixed with 4% by weight potassium iodide for only short periods of time (~6 hours). The image on hydroxypropyl cellulose faded to vanishing by overhead lighting in a few hours.

The optical image on the hydroxypropyl cellulose coating can be made quite latent and subsequently developed with a water swatch.

EXAMPLE 12

A formulation was prepared by dissolving 5% by weight ethylcellulose which was 45.7% ethoxy in 60% toluene and 40% methanol. This formulation was used to make imageable coatings from 1% to 15% tetrahydrofurane saturated with TCNQ. It was found that (10–15)% tetrahydrofurane saturated with TCNQ gave the best results in terms of contrast.

A 7% tetrahydrofurane solution, saturated with TCNQ, was imaged through a high density negative mask for 10 minutes at 350 nm. The imaged area was of a dark green color on a light yellow-green background. The substrate was Allied X904 paper basestock.

A portion of the imaged coating, obtained as above, was swatched with a cotton pad moistened with methanol saturated with dimethylolurea. The coating was heated in the oven at 80° C. for 2 hours. The treated portion was now rubbed with a cotton pad moistened with methanol saturated with dimethylolurea. The surface film rubbed off, but a thin absorbed portion remained affixed to the substrate with the image appearing thereon colored a light blue. This image remained fixed, at least for 60 days.

An imaged coating was obtained as above and the coating swatched with a 4% by weight solution of hydroquinone in methanol-water (50%). The swatched portions retained a blue imaged area on a light yellow-green background. This portion remained fixed for at least 60 days.

A formulation of ethylcellulose in the above solvent system was made 14% in tetrahydrofurane saturated with TCNQ. This coating was imaged through a high density negative mask at 350 nm for 10 minutes and gave a green image area on a light yellow-green background. Upon blanket irradiation of this coating at 250 nm for 10 minutes, the imaged areas changed to a tan-orange color.

Instead of ethylcellulose, hydroxyethyl cellulose, or hydroxpropyl cellulose, in the foregoing examples, use can be made of other alkyl celluloses and hydroxy derivatives thereof.

The solvent medium in which the materials are dissolved for coating onto various substrates is not significant as long as the components are readily soluble therein. For example, use can be made of tetrahydrofuran, toluene, methanol, ethanol, ethylacetate, acetone and water, and mixtures thereof, as representative of the variety of solvents that can be used. Instead of paper or Mylar film, other substrates, such as metal, glass, films of other transparent, translucence or opaque plastic material can be used as the substrate of the coating.

The coating composition can be applied by other coating techniques such as roller coating, wire coating, brush coating, flow coating, spray coating and other coating processes in coating sheets that may vary from very thin coatings of 1,000 grams per 3,000 square feet to heavier coatings of 10,000 grams per 3,000 square feet. The applied coatings can be air dried, or drying can be accelerated by air drying at elevated temperatures up to 200° F.

The desired results can be achieved in accordance with the practice of this invention when the amount of TCNQ in the coating is within the range of 0.0010–0.030 parts by weight TCNQ per 1 part by weight of the cellulose derivative and preferably within the range of 0.002–0.02 parts by weight of TCNQ per 1 part by weight of the cellulose derivative.

It will be understood that changes may be made in the details of composition, formulation and use without departing from the spirit of the invention, especially as defined in the following claims.

I claim:

1. A photographic medium comprising a substrate and a coating on the substrate formulated of 7,7,8,8-tetracyanoquinodimethane (TCNQ) and an alkyl cellulose or a hydroxyalkyl cellulose which is an electron donor and capable of forming charge transfer complexes with TCNQ as an electron acceptor to produce either a latent image or a visible image when exposed to ultraviolet radiations.

2. A photographic medium as claimed in claim 1 in which the sensitivity of the coating to provide the image occurs in response to exposure to light radiation within the range of 250–400 nanometers.

3. A photographic medium as claimed in claim 1 in which the visible image is directly produced in dry form.

4. A photographic medium as claimed in claim 1 in which the cellulose component is selected from the group consisting of ethyl cellulose, hydroxyethyl cellulose and hydroxypropyl cellulose.

5. A photographic medium as claimed in claim 1 in which the visible image can be intensified by wetting it with aqueous medium.

6. A photographic medium as claimed in claim 1 in which the visible image can be made to disappear by exposure to room lighting, sunlight and elevated temperature.

7. A photographic medium as claimed in claim 1 in which, the latent image can be developed by treatment with aqueous medium.

8. A photographic medium as claimed in claim 1 in which the visible image can be fixed by exposure to a mild reducing agent.

9. A photographic medium as claimed in claim 8 in which the mild reducing agent is a solution of potassium iodide or hydroquinone.

10. A photographic medium as claimed in claim 1 in which the visible image can be retained over an extended period of time by protection from atmospheric radiations.

11. A photographic medium as claimed in claim 1 in which the coating composition includes a polyvinyl alcohol.

12. A photographic medium as claimed in claim 1 in which the coating composition includes a quaternary salt whereby the photographic medium is converted to a photographic negative.

13. A photographic medium as claimed in claim 1 in which the coating composition includes an additive selected from the group consisting of an acrylate and dimethylolurea which polymerizes during exposure to produce a more durable coating and increased image retention.

14. A photographic medium as claimed in claim 1 in which the coating composition includes a fluorescent dye.

15. A photographic medium as claimed in claim 1 in which the coating composition includes oxalic acid which enhances the durability and life of the developed image.

16. A photographic medium as claimed in claim 1 in which the substrate is a film of a synthetic resinous material.

17. In an image development process, the step of producing a photographic medium which is sensitive to radiations in the ultraviolet range to produce either a latent image or a visible image when exposed to ultraviolet radiations providing a substrate having a coating formulated of 7,7,8,8-tetracyanoquinodimethane (TNCQ) and an alkyl cellulose or a hydroxyalkyl cellulose which is an electron donor and capable of forming charge transfer complexes with (TNCQ) upon exposure to ultraviolet radiations, and exposing the coated substrate imagewise to ultraviolet light whereby a latent image or a visible image is produced in the exposed portions of the coating.

18. The process as claimed in claim 18 in which the cellulose derivative is selected from the group consisting of ethyl cellulose, hydroxyethyl cellulose and hydroxypropyl cellulose.

19. The process as claimed in claim 17 in which the cellulose component and 7,7,8,8-tetracyanoquinodimethane is formulated in a coating composition in which the solvent is selected from the group consisting of tetrahydrofurane, toluene, methanol, ethanol, ethylacetate, acetone and combinations thereof alone or with water.

20. The process as claimed in claim 17 in which the coated substrate is exposed to reduction within the range of 250–400 nanometers for image development.

21. The process as claimed in claim 17 which includes the step of wetting the visible image with water to intensify the visible image.

22. The process as claimed in claim 17 which includes the step of exposing the visible image to room lighting, sunlight, or elevated temperature to cause disappearance of the visible image.

23. The process as claimed in claim 17 which includes the step of fixing the visible image by wetting with a mild reducing agent.

24. The process as claimed in claim 23 in which the mild reducing agent is potassium iodide or hydroquinone in aqueous medium.

25. The process as claimed in claim 17 which includes the step of exposing the coating to 250–400 nanometers wherein the color density varies to enable calibration as an ultraviolet dosimeter.

26. The process as claimed in claim 17 which includes the step of protecting the visible image from radiations for preservation of the visible image over an extended period of time.

27. The process as claimed in claim 17 which includes polyvinyl alcohol in the coating.

28. The process as claimed in claim 17 wherein, by inclusion of a quaternary salt in the coating composition, the photographic medium is converted to a photographic negative.

29. The process as claimed in claim 17 in which an acrylate or dimethylolurea is included within the coating composition which, upon exposure of the wating, polymerizes to produce a more durable coating and a more lasting image.

30. The process as claimed in claim 17 which includes the step of wetting the visible image with oxalic acid to enhance durability and the life of the image.

31. The process as claimed in claim 17 which includes the step of overcoating the visible image with a removable vinyl topcoat to protect the visible image.

* * * * *

UNITED STATES PATENT OFFICE

CERTIFICATE OF CORRECTION

Patent No. 4,262,074 Dated April 14, 1981

Inventor(s) James M. Halm

It is certified that error appears in the above-identified patent and that said Letters Patent are hereby corrected as shown below:

Column 8, line 3, after "claim" change the numeral "18" to -- 17 -- .

Signed and Sealed this

*Eighteenth* Day of *August 1981*

[SEAL]

*Attest:*

GERALD J. MOSSINGHOFF

*Attesting Officer*

*Commissioner of Patents and Trademarks*